US011471893B2

(12) United States Patent
Neer et al.

(10) Patent No.: US 11,471,893 B2
(45) Date of Patent: Oct. 18, 2022

(54) GRINDER ACCESSORY FOR PUMP

(71) Applicant: Crane Pumps & Systems, Inc., Piqua, OH (US)

(72) Inventors: Kirk Neer, St. Paris, OH (US); Alex Crabtree, Englewood, OH (US)

(73) Assignee: Crane Pumps & Systems, Inc., Piqua, OH (US)

( * ) Notice: Subject to any disclaimer, the term of this patent is extended or adjusted under 35 U.S.C. 154(b) by 285 days.

(21) Appl. No.: 16/920,087

(22) Filed: Jul. 2, 2020

(65) Prior Publication Data

US 2022/0001388 A1 Jan. 6, 2022

(51) Int. Cl.

| | |
|---|---|
| ***F04D 7/00*** | (2006.01) |
| ***B02C 18/00*** | (2006.01) |
| ***F04D 29/22*** | (2006.01) |
| ***F04D 7/04*** | (2006.01) |

(52) U.S. Cl.

CPC ..... *B02C 18/0092* (2013.01); *F04D 7/045* (2013.01); *F04D 29/2288* (2013.01); *B02C 2201/063* (2013.01)

(58) Field of Classification Search

CPC ..... B02C 18/0092; B02C 18/18; B02C 2201/063; F04D 7/045; F04D 29/2288; F04C 2/00

See application file for complete search history.

(56) References Cited

U.S. PATENT DOCUMENTS

| | | | | |
|---|---|---|---|---|
| 5,019,136 | A * | 5/1991 | Elonen | F04D 29/428 415/168.1 |
| 5,044,566 | A | 9/1991 | Mitsch | |
| 5,167,678 | A * | 12/1992 | Elonen | F04D 29/428 96/214 |
| 5,460,482 | A | 10/1995 | Dorsch | |
| 5,816,510 | A | 10/1998 | Earle, III et al. | |
| 7,159,806 | B1 * | 1/2007 | Ritsema | F04D 3/02 241/89.4 |
| 7,357,341 | B2 | 4/2008 | Gutwein et al. | |
| 9,475,059 | B2 | 10/2016 | Vallen et al. | |
| 9,719,527 | B2 | 8/2017 | Mitsch | |

(Continued)

FOREIGN PATENT DOCUMENTS

| | | |
|---|---|---|
| DE | 102011018434 A1 | 10/2012 |
| EP | 2586531 A2 | 5/2013 |

(Continued)

*Primary Examiner* — Faye Francis

(74) *Attorney, Agent, or Firm* — Standley Law Group LLP; Stephen Grant; Adam Smith

(57) ABSTRACT

A grinder accessory is useful for a pump in a wastewater application. The grinder accessory has a cutter plate and a cutting body that co-act on solids, especially fibriform solids. The cutter plate has first and second planar faces, mounted in an inlet of the pump, with a plurality of through holes and a central aperture. The cutting body is poised atop the first planar face and extends through the central aperture to rotationally couple with a drive shaft of the pump. A central hub of the cutting body has a plurality of arms that extend radially proximate to the first planar face, so that a leading edge of the arms interacts with the through holes on solids passing therethrough. A housing defines a cutting chamber around the cutter plate and the cutting body to protect them and to induce swirling action.

22 Claims, 9 Drawing Sheets

(56) References Cited

U.S. PATENT DOCUMENTS

| | | | | |
|---|---|---|---|---|
| 9,726,179 | B2 | 8/2017 | Dumonceaux | |
| 10,174,769 | B2 | 1/2019 | Mitsch | |
| 10,364,821 | B2 * | 7/2019 | Pohler | F04D 29/2288 |
| 10,487,835 | B1 * | 11/2019 | Ciotola | F04D 29/2288 |
| 11,253,866 | B2 | 2/2022 | Backe | |
| 2005/0053461 | A1 * | 3/2005 | Doering | F04D 29/2288 415/121.1 |
| 2009/0067992 | A1 * | 3/2009 | Keener | F04D 7/045 415/121.1 |
| 2014/0263788 | A1 * | 9/2014 | Vallen | B02C 18/0092 241/220 |
| 2016/0363123 | A1 | 12/2016 | Davis | |
| 2018/0202453 | A1 * | 7/2018 | Pohler | B02C 18/0092 |
| 2020/0353475 | A1 * | 11/2020 | Brinkmann | F04D 7/045 |
| 2021/0170421 | A1 * | 6/2021 | Hobbs | B02C 18/2225 |

FOREIGN PATENT DOCUMENTS

| | | | |
|---|---|---|---|
| EP | 3309401 | A1 | 4/2018 |
| EP | 3670920 | A1 | 6/2020 |
| GB | 584395 | | 1/1947 |
| KR | 100918876 | B1 | 9/2009 |

* cited by examiner

GRINDER ACCESSORY FOR PUMP

CROSS-REFERENCE TO RELATED APPLICATIONS

This application is a non-provisional patent application that makes no priority claim.

TECHNICAL FIELD

The embodiments disclosed herein relate to improvements in a grinder accessory for converting a pump into a grinder pump, especially for use in a wastewater application. The cutting geometry of the grinder accessory is useful in a wide variety of types of grinder pumps. The cutting geometry improves the clog and jam resistance of the pump by controlling the debris that the cutting elements encounter and by providing effective size reduction, particularly with fibriform debris, of the material passing through the cutting geometry, the improvements may widen even further the types and capacities of pumps which can serve as grinder pumps. In one aspect of the inventive concept, both cutting elements are recessed into a cutting chamber that protects the cutting elements while limiting access thereto. In another aspect of the inventive concept, the cutting elements comprise a fixed cutter plate and a rotating cutting body, each of which has a curved cutting surface, so that the surfaces impose a scissor-like action on material passing therethrough.

BACKGROUND OF THE ART

The term "grinder pump" generally refers to a pump used in a wastewater application, especially in a sewer basin that contains a substantial amount of foreign matter such as solids and/or fibriform matter. Such a pump can be a conventional pump, but it is equipped with a grinder accessory, typically a blade arranged for rotation and, in very close proximity, a non-rotating cutting plate. The suction end of the grinder pump is typically submersed in the wastewater.

A patent, U.S. Pat. No. 7,357,341, owned by the applicant, describes the application of grinder pumps in such applications, where development of head is preferred over flow rate. In that patent, a two-stage vortex centrifugal pump is used to increase the output head achieved, compared to a single-stage centrifugal. Although some patents have used progressing cavity pumps, these are believed to have poor reliability in abrasive waste water application.

Focusing on sewer basin applications, a grinder pump is positioned low in the basin, with the suction at the bottom of the pump, facing the bottom of the basin and submerged in the wastewater. The unpleasant nature of maintaining a grinder pump in this setting means that a high degree of reliability is essential. To that end, the ability of the grinder accessory to prevent clogging, especially from the fibriform waste, is critical. This is best achieved by restricting elongate fibrous material to passing through the grinder accessory in an axial direction of the fibrous material, so it can be chopped into a form in which the length to diameter aspect is significantly reduced.

While a number of published patent applications and issued patents have claimed to effectively deal with fibriform waste, the ongoing stream of such disclosures demonstrates the unmet needs of the prior art.

It is therefore an unmet advantage of the prior art to provide reliable handling of wastewater containing fibriform waste

SUMMARY OF THE INVENTION

This and other unmet advantages are provided by a grinder accessory for use with a pump. Such a grinder accessory has a set of co-acting cutter elements and a housing that encompasses the cutter elements. The cutter elements are a cutter plate and a cutting body. The cutter plate has a first planar face and a second planar face, opposite the first planar face, with a plurality of through passages and a central aperture. The cutting body is arranged to extend axially through the central aperture and extend axially outward from each planar face of the cutter plate. A first portion of the cutting body has a plurality of arms that extends radially from a central hub proximate to the first planar face and a second portion extends axially from the second planar face, with the second portion being adapted for rotational coupling to a drive shaft of the pump. The housing is mountable on or integral with the pump, defining a cutting chamber having an inner diameter effectively equal to a diameter of the cutter plate, which is mounted therein, and an axial height, measured from the first planar face of the cutter plate, that exceeds an axial height of the cutting body as measured from the first planar face.

In many embodiments, each of the co-acting cutter elements has an axis of rotational symmetry.

In many embodiments, the number of through holes in the cutter plate exceeds the number of arms of the cutting body.

In many embodiments, the number of through holes in the cutter plate is an even number and the number of arms of the cutting body is an odd number, and, particularly, the number of arms in the cutting body is not an integral divisor of the number of through holes in the cutter plate.

In the embodiments, each of the plurality of through holes in the cutter plate has a "D"-shape profile, with a straight edge joined to a curved edge. Preferably, the through holes are located on the cutter plate such that the straight edge is aligned on a radius of the first planar face. In such a case, each through hole has a counterpart through hole that is diametrically opposed on the first planar face with the respective straight edges aligned on a common diameter.

Many embodiments will further comprise a plurality of first grooves on the first planar face, each of which extends in a non-radial manner from a circumference of the cutter plate, each of the first grooves having a termination on the first planar face, short of an outer diameter of the central aperture. In many embodiments, the number of the first grooves is equal to the number of through holes and the termination of each of the plurality of first grooves is located between a pair of adjacent through holes.

Many embodiments will also comprise a plurality of second grooves on the first planar face. These will often extend in a radial manner from an outer diameter of the central aperture, and have a termination on the first planar face, short of the circumference of the cutter plate.

Many embodiments will also comprise an annular rim around, and extending axially from, the second planar face.

In the cutting body, each of the arms extends in a radial line from an axis of the central hub to a tip and each of the arms has a height in the axial direction that decreases from the root to the tip, with a maximum height of the arms located along the radial line.

Preferably, each of the arms has a leading edge that extends in a curved manner from the root to the tip and each of the arms is generally hollow behind the leading edge thereof.

In the preferred embodiments, each of the through holes in the cutter plate has a "D"-shape profile, with a straight edge joined to a curved edge, and each of the arms of the cutting body has a leading edge that is curved from a root thereof to a tip thereof, with the through holes and arms arranged on their respective parts such that when the cutting body rotates relative to the cutter plate, the curved leading edge of the cutting body moves first across the straight edge of the through hole before encountering the curved edge of the through hole.

Other aspects of the inventive concept are achieved by a grinder pump that comprises a pump, having a suction inlet; and a grinder accessory, as described above, mounted in or integral with the suction inlet. In such a grinder pump, the pump further comprises a drive shaft for an impeller thereof, the drive shaft having an end thereof that is aligned with the suction inlet and that is rotationally coupled to the cutting body of the grinder accessory. Preferably, the number of arms in the cutting body is not an integral divisor of the number of through holes in the cutter plate.

BRIEF DESCRIPTION OF THE DRAWINGS

A better understanding of the disclosed embodiments will be obtained from a reading of the following detailed description and the accompanying drawings wherein identical reference characters refer to identical parts and in which.

DETAILED DESCRIPTION

Figure 1:
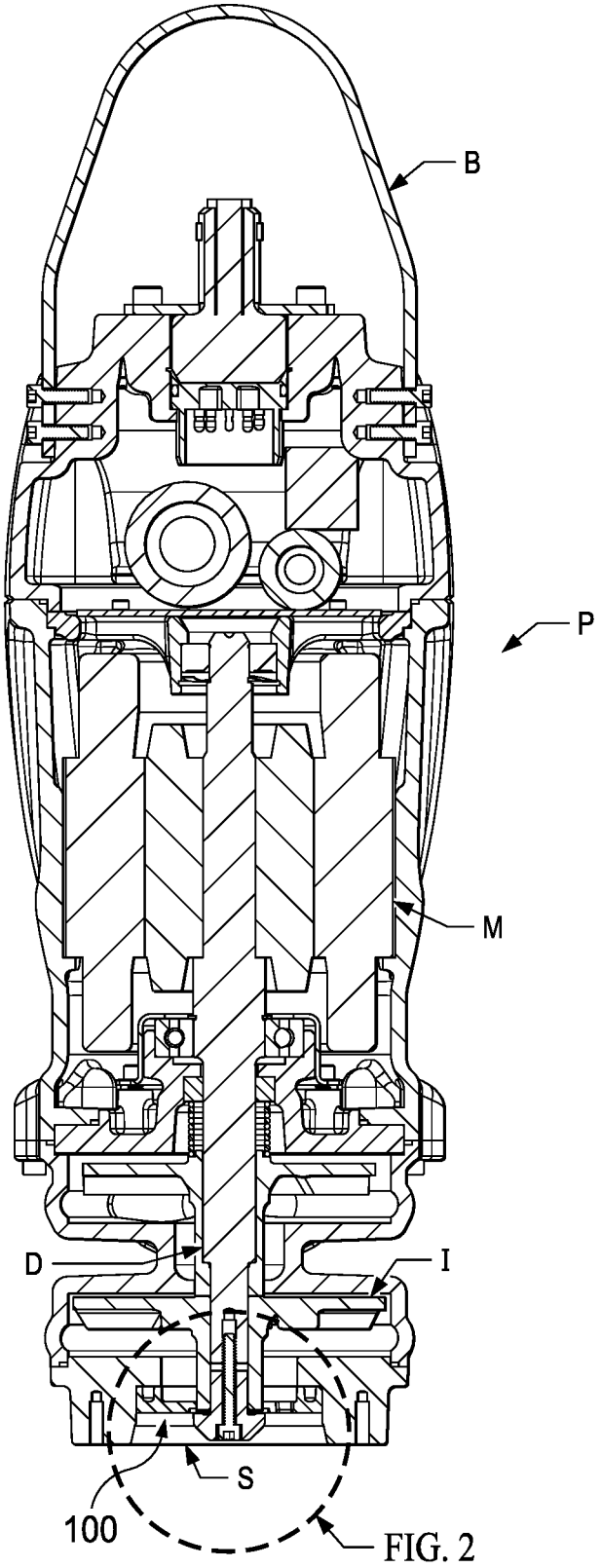
FIG. 1 is a side-sectional view of a pump for use in a wastewater basin, with a grinder accessory of the present invention installed at a lower portion thereof, with further details of the grinder accessory shown in the enlarged side-sectional view in FIG. 2.
Figure 2:
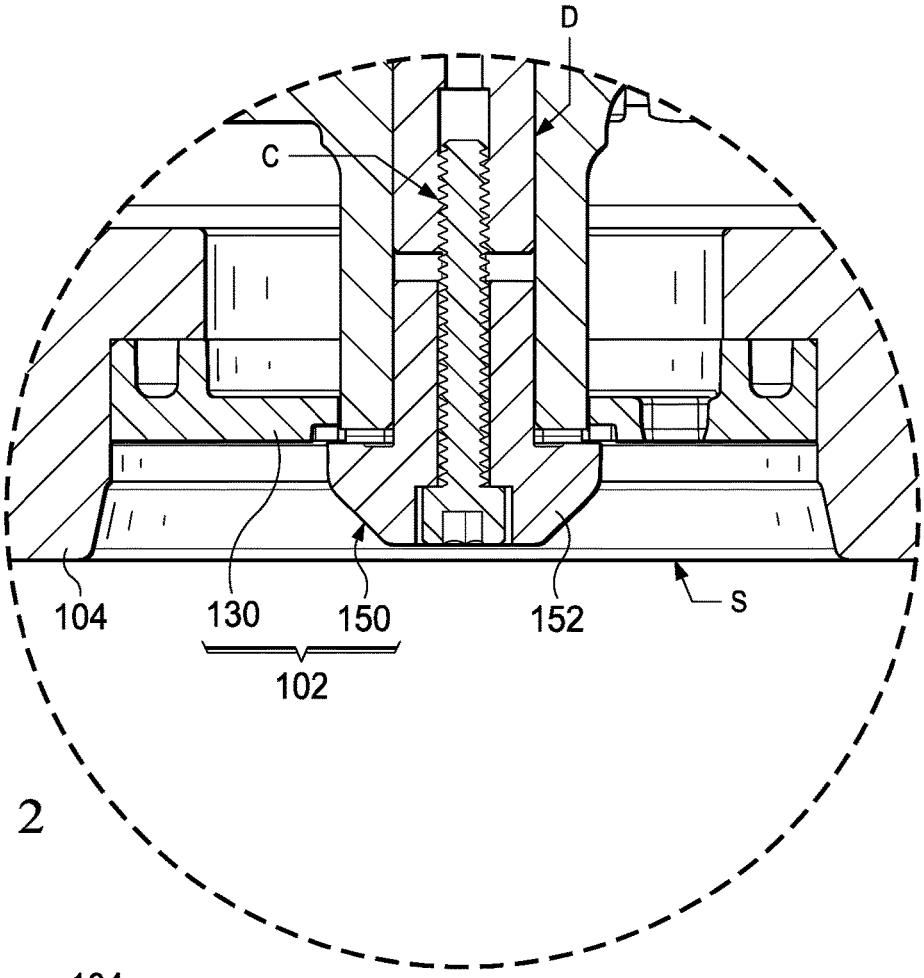
FIG. 2 is an enlarged side-sectional view of the grinder accessory.
Figure 3:
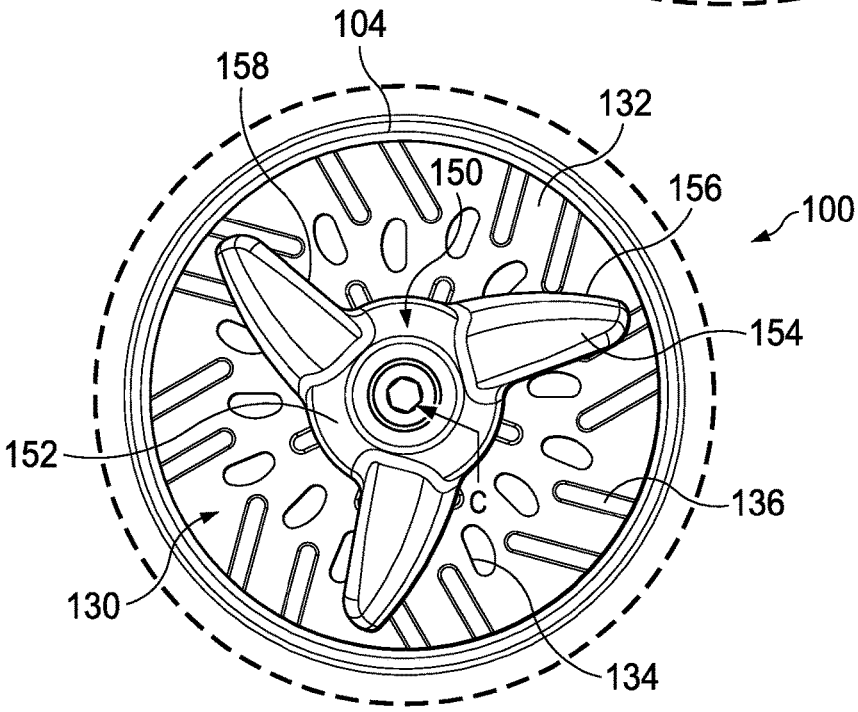
FIG. 3 is an enlarged bottom plan view of the enlarged side-sectional view of FIG. 2.

Referring first to FIGS. 1 through 3, the inventive concept is shown in its operational environment. FIG. 1 is a side-sectional view that shows a typical pump P which has been adapted by inclusion of a grinder accessory 100 to allow the pump to be used as a grinder pump. The grinder accessory 100 facilitates use of the pump P, either of a conventional style or of a style to be developed, in a sewer basin or similar application where solids, and especially fibriform solids are encountered. The conventional pump P of this type will have a suction inlet S, especially one that is located on a lower portion of the sewer basin or other container in which the pump is mounted, with the inlet S near, but spaced away from, a bottom surface of the basin. In many cases, such as where the pump P is a centrifugal pump, the suction inlet S will be below and aligned with an axis of a drive shaft D on which an impeller I of the pump is mounted. The pump P will also be provided with a motor M at a first end of the drive shaft D and the impeller I towards the second end of the drive shaft, although the drive shaft may extend below the impeller so that it can be coupled to the grinder accessory 100. Viewed from below, that is, from the suction inlet S looking into the pump P towards the impeller I, it is conventional that the drive shaft D will rotate in a counter-clockwise manner, that is, using the so-called "right hand rule." Throughout this application, the face of the grinder accessory 100 that faces outwardly from the suction inlet S will be referred as the "top" face and the opposite face as the "bottom" face. This is for convenience in the subsequent drawings, even though the "top" face of the grinder accessory, in operation, will be facing downwardly toward the bottom of the basin. A bale B for lowering the pump P into position in the basin (or removing the pump therefrom) is provided at an upper end of the pump above the motor. Many other features of the pump P will be recognizable to one of skill, so they are not described here.

A portion of FIG. 1 that is shown in a dotted circle is shown in an enlarged side sectional view as FIG. 2, to which attention is now directed. The grinder accessory comprises a set of cutter elements 102 that co-act to reduce the size of solids entering into the pump P through suction inlet S, as well as a housing 104 that surrounds the set of cutter elements. The cutter elements 102 are a cutter plate 130 and a cutting body 150, details of which will be provided with regard to subsequent figures. As seen here, an end of the drive shaft D that rotates the impeller I of the pump extends axially through the impeller and is adapted for rotational coupling, as by a coupler C, to the cutting body 150, to co-rotate with the impeller.

The cutter plate 130 is arranged between the end of the drive shaft D, which remains on a rear (or second) planar face of the cutter plate and a main portion of the cutting body 150, which has a central hub 152 positioned on a front (or first) planar face of the cutter plate 150. The cutter plate 130 is fixed in place, with the planar faces arranged perpendicular to an axis of the drive shaft D.

The housing 104 is mountable on, or integral with, the pump, especially the suction inlet S. More particularly, the housing 104 is located to position and retain the cutter plate 130 at the suction inlet. The housing 104 defines a cutting chamber that is preferably cylindrical, with an inner diameter that is effectively equal to a diameter of the circular cutter plate 130. The housing 104 also has an axial height, as measured from the first planar face of the cutter plate 130, that exceeds an axial height of the cutting body 150, and especially its central hub 152, as measured from the first planar face.

When rotated by the drive shaft D, the cutting body 150 sets up a swirling action in the cutting chamber, especially between the radially outward ends of cutting arms that extend radially outward from the central hub 152 and the inner diameter of the housing 104. This swirling action limits the ability of debris to approach the cutting chamber when the cutting body 150 is rotating in the housing 104. By controlling and directing the flow of the debris, the potential for clogging or jamming the cutting elements 102 is reduced. The swirling action in the cutting chamber allows the grinder accessory 100 to make multiple attempts to grind a specific piece of debris. If a piece of debris is not cut and passed through the grinder accessory 100 in a first pass, it is rejected out into a wetwell of the basin. The rejection can amount in some cases to a complete rejection of the object, but in other cases, it will amount to a part of the object being cut and passed through, with the remainder being rejected, allowing it to approach subsequently as a smaller object for one or more passes.

The housing 104 provides an additional benefit beyond the swirling action. In general, grinder accessories of the prior art have had a cutter that extended out of the bottom of the pump, which exposes the cutter to damage, either by being dropped or by being hit by large debris in the wetwell. By encompassing the cutting elements 102 in the cutting chamber of the housing 104, the cutting elements are protected.

FIG. 3 provides an enlarged plan view of the grinder accessory 100, looking from below into the cutting chamber. In this view, the close relationship of the housing 104 to the diameter of the cutter plate 130 is seen. The exposed face of the cutter plate is a first planar face 132. A plurality of through holes 134 extend from this first planar face 132 to a second planar face (not seen in FIG. 3), as well as a plurality of first grooves 136, which are formed in the first planar face 132, but which do not extend to the second planar face. Other features of the cutter plate are concealed in this view by the cutting body 150.

The notable features of the cutting body 150 in FIG. 3 include the central hub 152 and a head of the coupler C. The cutting body 150 has a plurality of arms 154 that extend outward from the central hub. Keeping in mind that the depicted embodiment is intended for the cutting body to rotate in a counterclockwise manner, each arm 154 has a curved leading edge 156 and a generally linear trailing edge 158. Each arm 154 extends in a radial direction (relative to the cutter plate 130) far enough to sweep the arm over the full range of the through holes 134 and a significant majority of the range of the first grooves 136, but the arms do not extend as far as the inner diameter of the housing 104. It is preferred that the arms 154 extend at least about 80% of the radial dimension of the cutter plate, and more preferably, the arms extend about 90% of the radial dimension. In the depicted embodiment of the cutting body 150, there are an odd number of the arms 154, and, more particularly, there are three such arms, arranged symmetrically around the central hub 152 in an equiangular manner. Beyond this, and as explained in more detail below, there is a preferred relationship between the number of arms 154 and the number of through holes 134 in the cutter plate 130.

Figure 4:
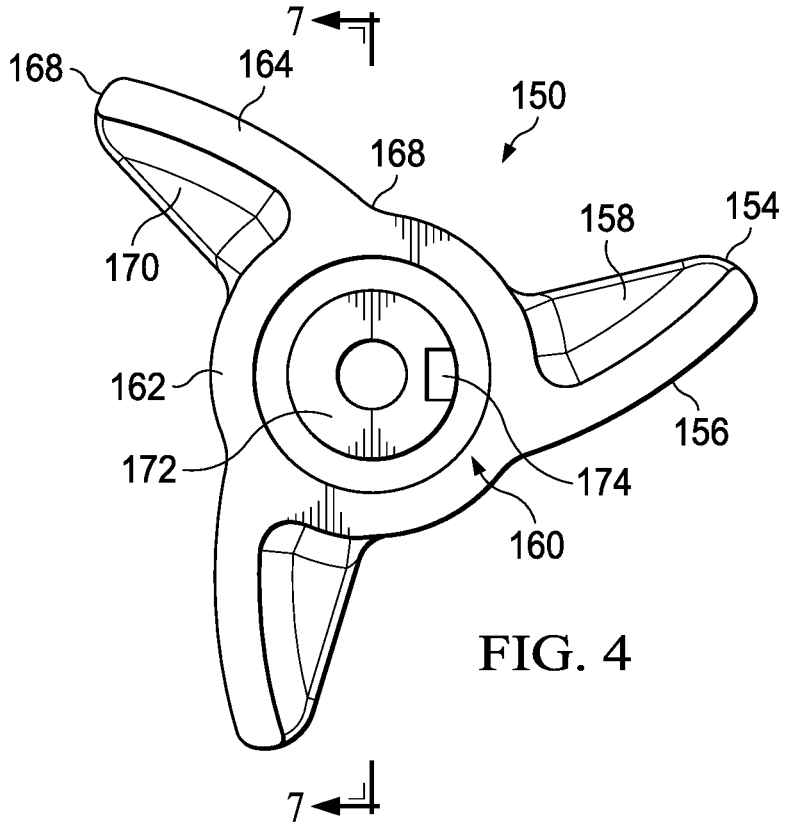
FIG. 4 is a bottom plan view of a cutting body incorporating the inventive concept.
Figure 5:
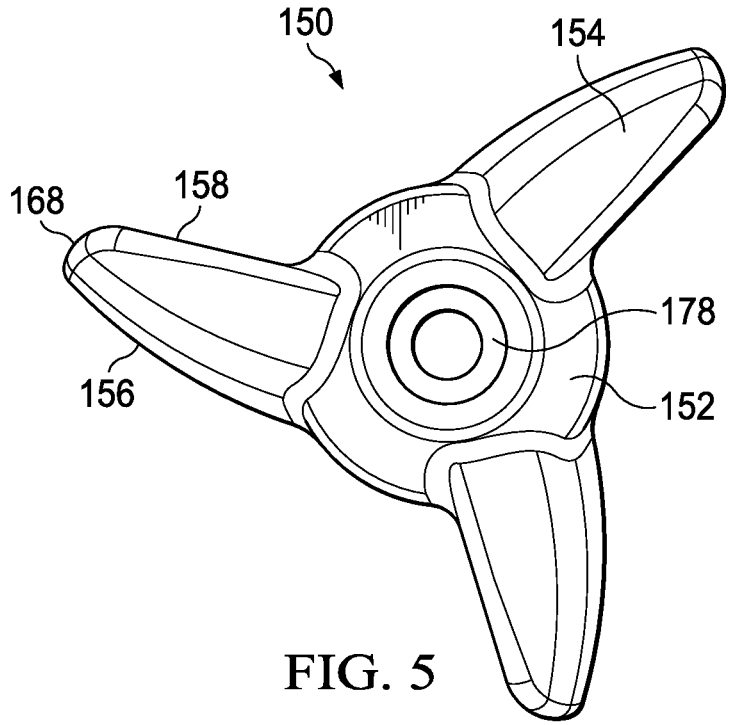
FIG. 5 is a top plan view of the FIG. 4 cutting body.
Figure 6:
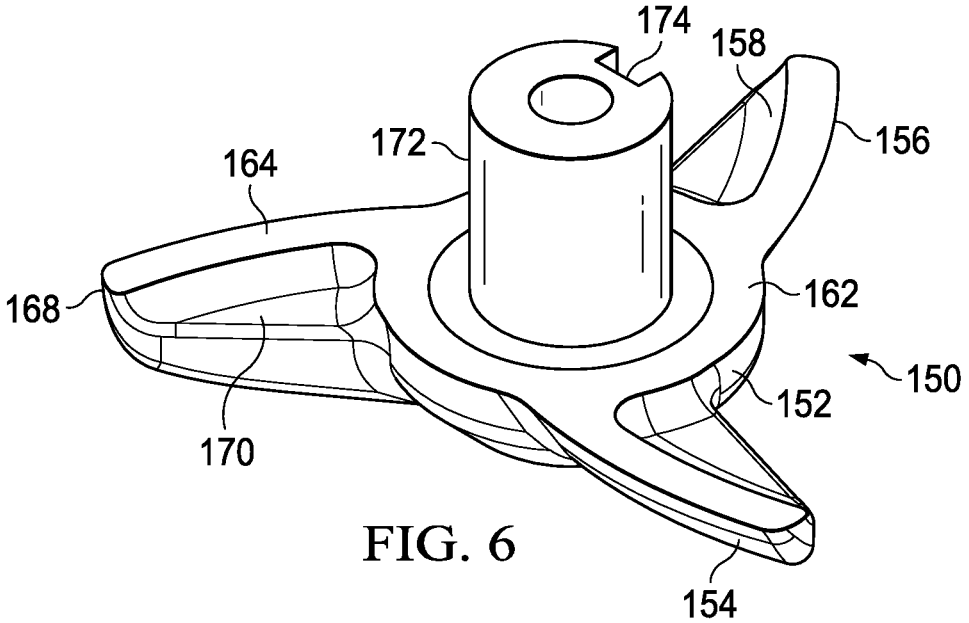
FIG. 6 is a bottom perspective view of the FIG. 4 cutting body.
Figure 7:
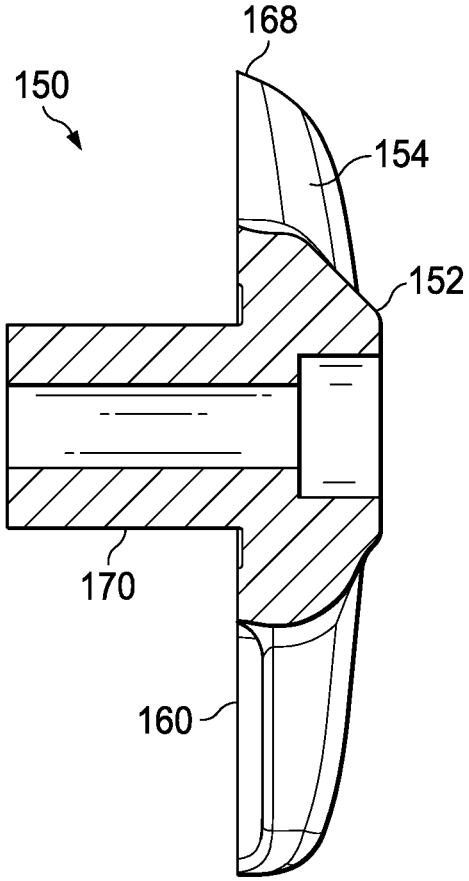
FIG. 7 is a side sectional view taken along line 7-7 of FIG. 4, through an axis of the cutting body.

Attention is now directed to the cutting body 150, which is depicted in isolation in FIGS. 4 to 7. FIG. 4 is a bottom plan view; FIG. 5 is a top plane view; FIG. 6 is a bottom perspective view and FIG. 7 is a sectional view taken along line 7-7 of FIG. 4. As mentioned above, the cutting body 150 has a central hub 152 with a plurality of arms 154 that extend outwardly from the central hub. Each of these arms 154 is configured with a leading edge 156 and a trailing edge 158, based upon the intended direction of rotation about a central axis. Because FIG. 4 is a bottom view, the intended direction of rotation in the plane of the figure is clockwise, while the intended direction of rotation of the cutting body 150 in FIG. 5 is counterclockwise.

Focusing on the bottom view, a base portion 160 of the cutting body 150 has an annular ring 162 at the base of the central hub 152. The base portion 160 also has, for each arm 154, a curved section 164 that extends from a root 166 on the annular ring 162, forming a portion of the leading edge 156 and terminating at a tip 168 of the arm. As best seen in FIG. 4, a portion 170 of each arm 154 behind the leading edge 156 is hollowed out. While seen better in FIGS. 6 and 7, a further feature of the cutting body 150 is a hollow shaft 172 that centers the cutting body relative to the cutter plate and assists with coupling the cutting body to the drive shaft of the pump. A feature of the hollow shaft 172 is a means for coupling the cutting body into rotation with the drive shaft, such as keyway 174.

FIG. 5 provides the top plan view of the cutting body 150. It can be seen here that a line from the central axis of the cutting body 150 to the tip 168 of each arm 154 is a radial line. It can be further noted that the trailing edge 158 is a line that is essentially parallel to that radial line. A recessed shoulder 178 in the central hub 152 can receive a head of a fastener (not shown in the Figure) used to attach the cutting body 150 to the drive shaft D. The cutting body 150 is intended for two purposes: providing, in cooperation with the cutter plate, a scissors action for solid material passing through the through holes; and generating swirling turbulent flow of liquid in the vicinity of the cutting elements. For this latter purpose, the upper surfaces of the central hub 152 and the arms 154 are designed for aerodynamic effect.

As seen in FIGS. 5 and 7, each arm 154 has a maximum height above the base portion 160 that generally decreases from its origin in the central hub 152 to the tip 168. Preferably, this decrease in height is monotonic and the maximum height at any radial distance along the arm is preferably along the radial line from the axis to the tip 168.

FIG. 6, as a bottom perspective view, provides particular insight as to two elements of the cutting body. First, it shows detail of the hollow shaft 172 and the keyway 174. Second, FIG. 6 provides detail of how the interior of each of the arms is hollowed out along the trailing edge for aerodynamic effect.

Similarly, FIG. 7 shows how the arms 154 originate from the central hub 152 and how recessed shoulder 178 is located in the central hub.

Figure 8:
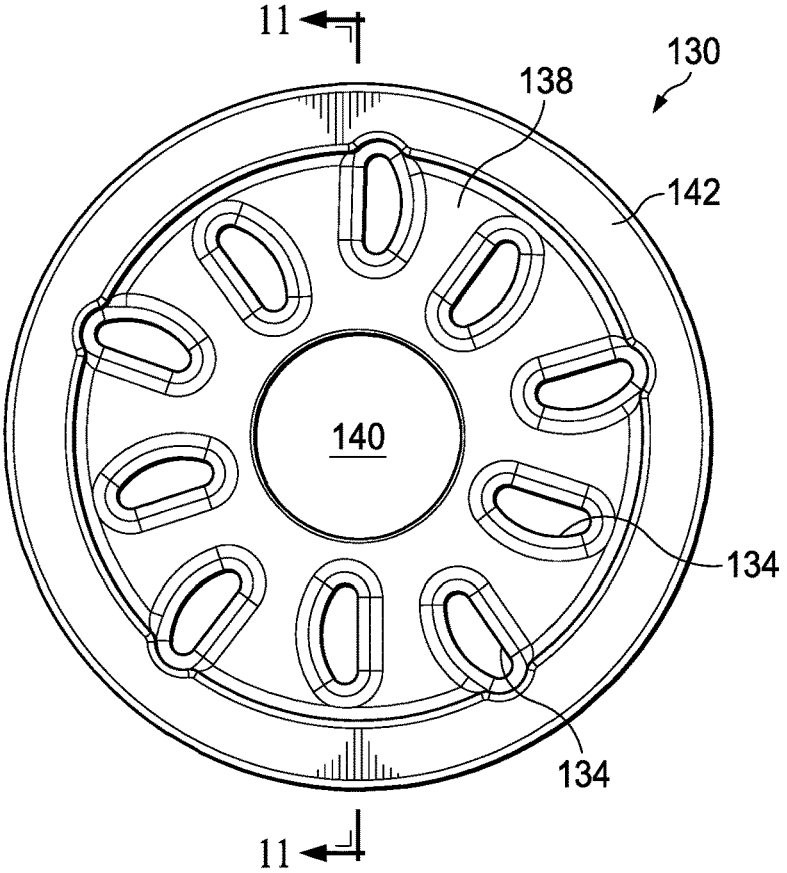
FIG. 8 is a bottom plan view of a first embodiment of a cutter plate incorporating the inventive concept.
Figure 9:
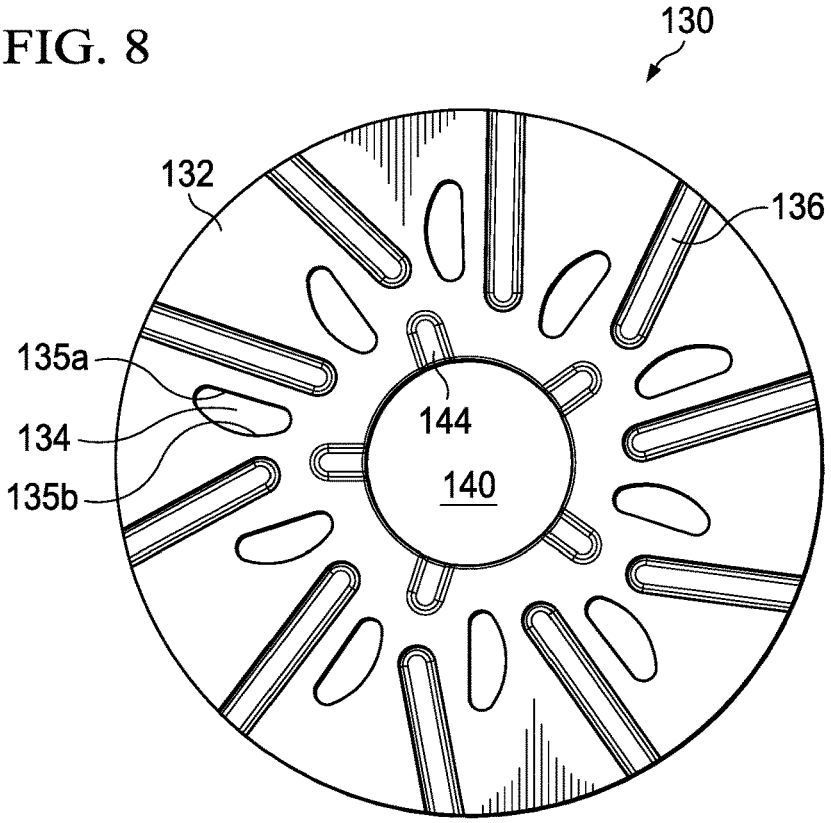
FIG. 9 is a top plan view of the FIG. 8 cutter plate.
Figure 10:
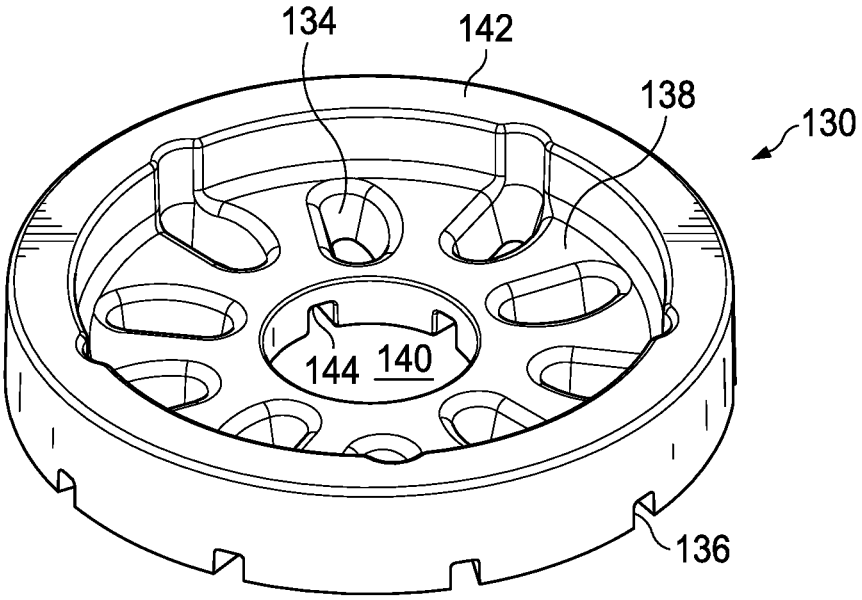
FIG. 10 is a bottom perspective view of the FIG. 8 cutter plate.
Figure 11:
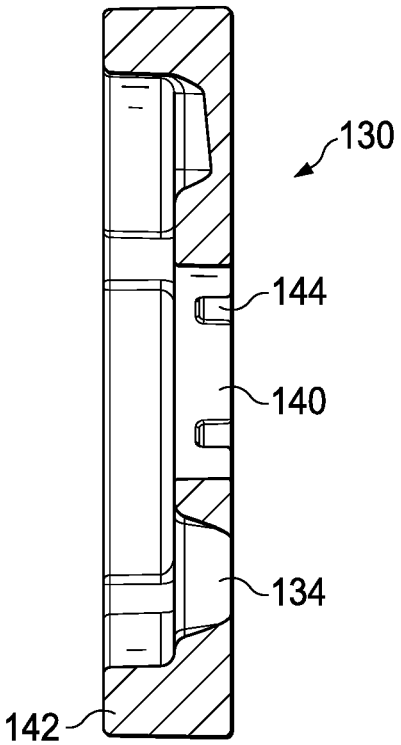
FIG. 11 is a side sectional view taken along line 11-11 of FIG. 8, through a diameter of the cutter plate.

FIGS. 8 through 11 show details of a first embodiment of the cutter plate 130. FIG. 8 is a bottom plan view; FIG. 9 is a top plan view; FIG. 10 is a bottom perspective view; and FIG. 11 is a side sectional view taken along line 11-11 of FIG. 8, through a diameter of the cutter plate 130.

The face of the cutter plate 130 seen in FIG. 8 is the second planar face 138, that is, a face of the cutter plate opposite the first planar face. The second planar face 138 faces into the pump interior and material reaching the second planar face has done so by passing though one of the through holes 134. As viewed from this bottom side, the through holes 134 are seen to increase in size in the passage from the first to the second planar face. This embodiment of the cutter plate 130 shown in FIG. 8 has ten through holes 134 and a central aperture 140. The cutter plate 130 has an axis of rotational symmetry, defined by the center of the central aperture 140.

In the embodiments of the cutter plate disclosed herein, in each case the number of through holes in the cutter plate 130 exceeds the number of arms of the cutting body 150. For example, in this case, the three arms 154 of the cutting body 150 are exceeded by the ten through holes 134. Further, the cutter plate 130 in each case has an even number of through holes while the number of arms of the cutting body is an odd number. And, more particularly, in each case, the number of arms in the cutting body is not an integral divisor of the number of through holes in the cutter plate. This has important implications, as will be explained.

A further feature seen in FIGS. 8, 10 and 11 is an annular rim 142 that extends axially around a circumference of the second planar face 138. While optional, this rim 142 is useful for engagement of the cutter plate into the pump.

Directing attention to FIG. 8, the first planar face 132 is now seen in more detail than in FIG. 3, due to the isolation from the cutting body. This includes details of the through holes 134, which are seen to have a "D"-shape profile, with a straight edge 135*a* joined to a curved edge 135*b*. Keeping in mind that this embodiment is intended for use with a cutting body that is rotating counterclockwise, the straight edge 135*a* will encounter a leading edge 156 of the cutting body before the corresponding curved edge 135*b* encounters the leading edge 156. The effect of this is an extended encounter between the respective curved edges, which is where the scissors action occurs.

In the embodiment as depicted in FIG. 9, each of the straight edges 135*a* is aligned on a radius of the first planar face. Because there are an even number of the through holes 134, each of the through holes has a counterpart through hole that is diametrically opposed on the first planar face, such that the respective straight edges are aligned on a common diameter. In some embodiments, such as in FIG. 9, the through holes 134 may be centered at different radial distances from the central axis.

A further feature seen in FIG. 9 is the plurality of the first grooves 136 seen also in FIG. 3. As depicted, there is one first groove 136 corresponding to each through hole 134. In the depicted embodiment, each first groove 136 is cut into the first planar face 132 and extends in a non-radial manner from a circumference of the cutter plate. Each of the first grooves having a termination on the first planar face, short of an outer diameter of the central aperture 140. The termination of each of the plurality of first grooves 136 is located between a pair of adjacent through holes 134.

FIG. 9 also shows a plurality of second grooves 144 on the first planar face. Each of the plurality of second grooves 144 extends in a radial manner from an outer diameter of the central aperture 140. Each of the second grooves 144 has a termination on the first planar face, short of the circumference of the cutter plate. The second grooves 144 allow flow of liquid from the first planar face into the central aperture.

FIG. 10 is a bottom perspective view of the cutter plate 130. The second planar face 138 of the cutter plate 130 is the visible face in this view. The annular rim 142 is seen very clearly here, including the fact that, in this instance, some of the through holes 134 intrude slightly into the annular rim. Two features of the first planar face are seen here: the origins of the first grooves 136 at the circumference of the cutter plate and the terminations of the second grooves 144 at the central aperture 140. These provide a concept of the depth of the grooves relative to the thickness of the cutter plate 130.

FIG. 11 is a side sectional view taken along line 11-11 of FIG. 8, through a diameter of the cutter plate 130. The central aperture 140, the annular rim 142, openings of the second grooves 144 and at least one through hole 134 are visible.

Figure 12:
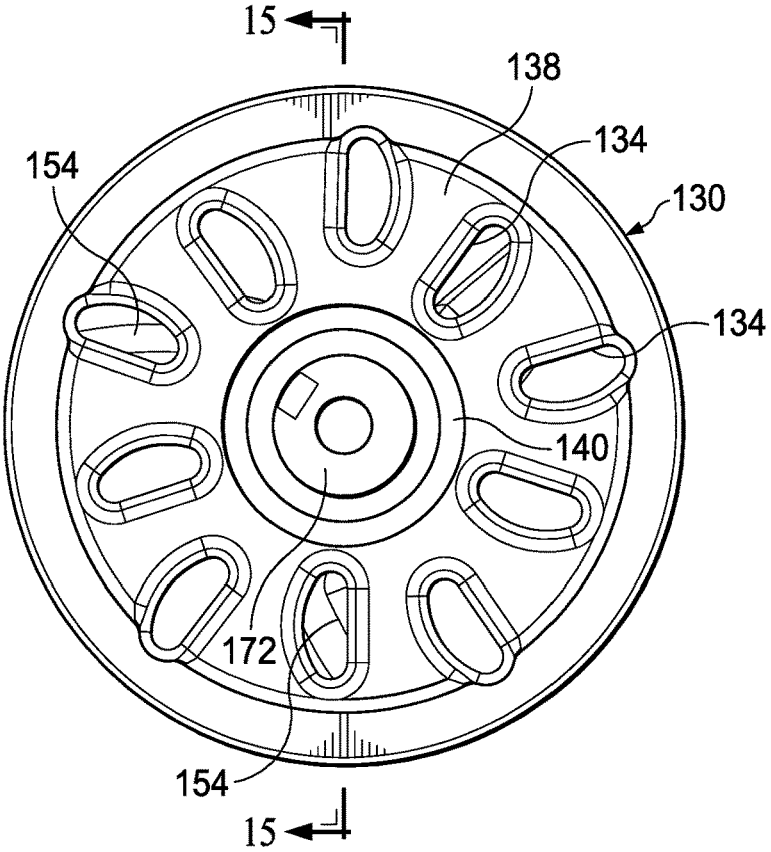
FIG. 12 is a bottom plan view of a FIG. 4 cutting body in operative position with the FIG. 8 cutter plate.
Figure 13:
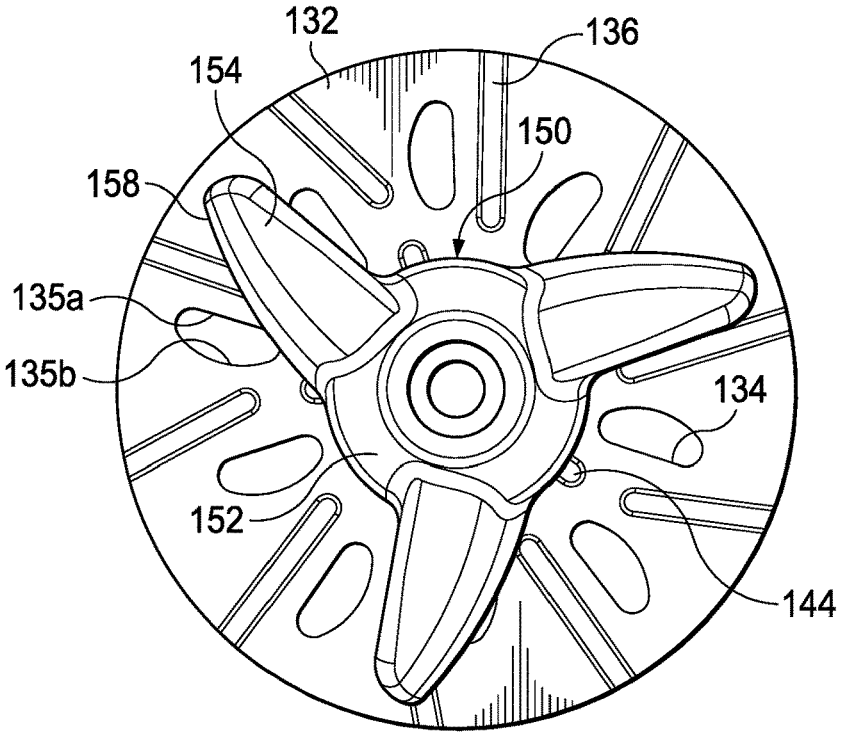
FIG. 13 is a top plan view of the FIG. 4 cutting body in operative position with the FIG. 8 cutter plate.
Figure 14:
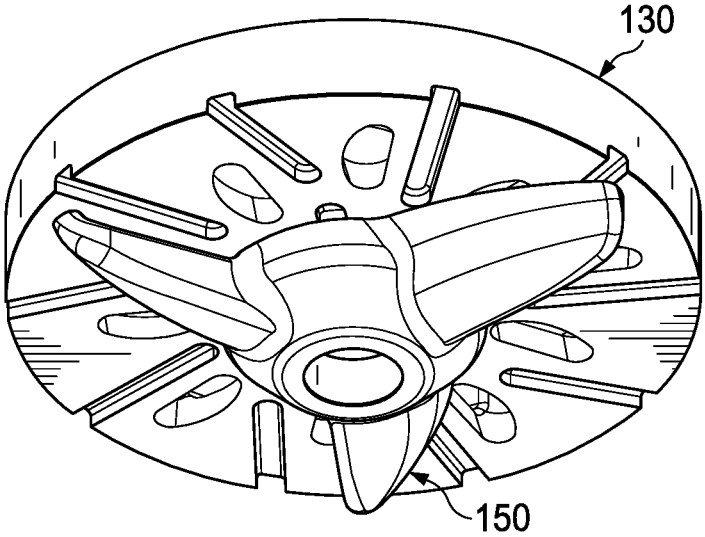
FIG. 14 is a top perspective view of the FIG. 4 cutting body in operative position with the FIG. 8 cutter plate.
Figure 15:
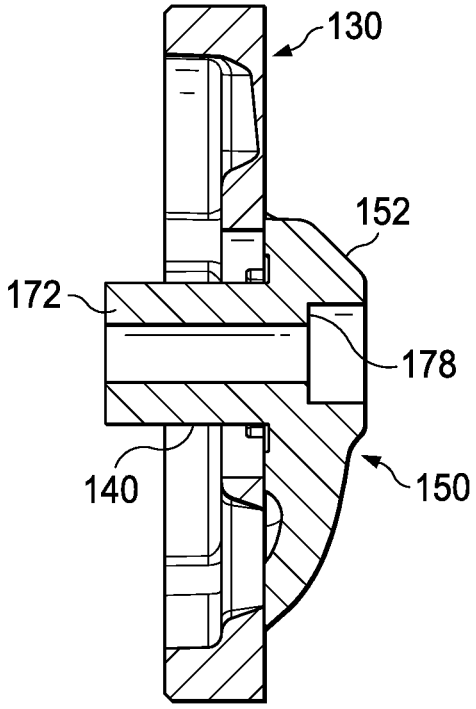
FIG. 15 is a side sectional view taken along line 15-15 of FIG. 13, through a diameter of the cutter plate.

FIGS. 12 through 15 show the cutting body 150 of FIG. 4 in operative position with the cutter plate 130 of FIG. 8. Of these, FIG. 12 is a bottom plan view; FIG. 13 is a top plan view; FIG. 14 is a top perspective view; and FIG. 15 is a side sectional view taken along line 15-15 in FIG. 12. While parts of the each of the cutting elements are identified in these figures, a feature that is particularly seen in FIGS. 12 and 13 is that, by requiring the number of arms 154 to not be an integral divisor of the number of through holes 134, the active scissors-type cutting action between a leading edge 156 and a curved edge 135*b* can be minimized, and preferably limited to one specific arm and through hole. This permits the cutting power to be focused rather than dispersed.

With regard to FIG. 15, the fit of hollow shaft 172 in central aperture 140 should be sufficiently open so that liquid can flow through.

Figure 16:
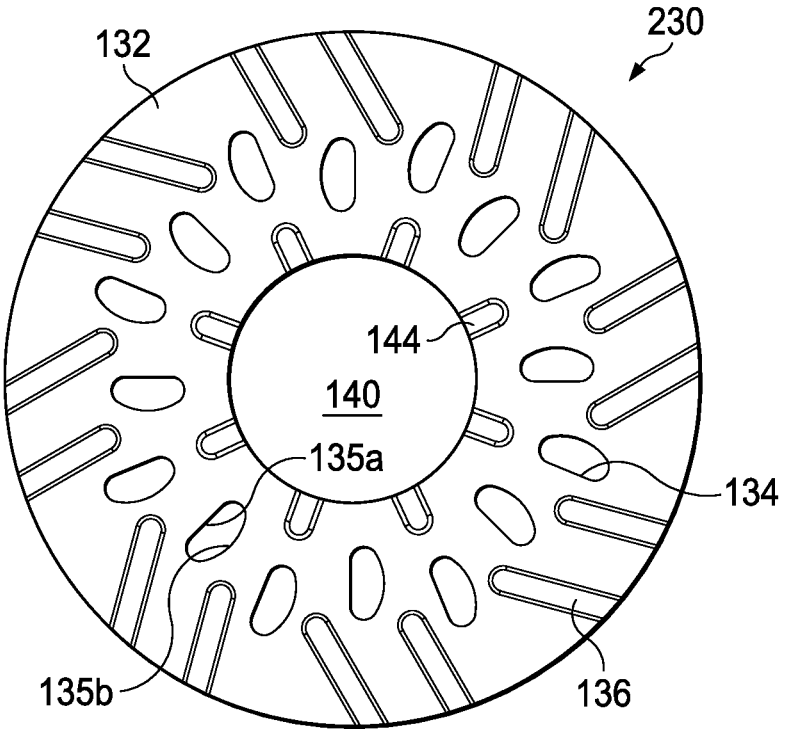
FIG. 16 is a top plan view of a second embodiment of the cutter plate.
Figure 17:
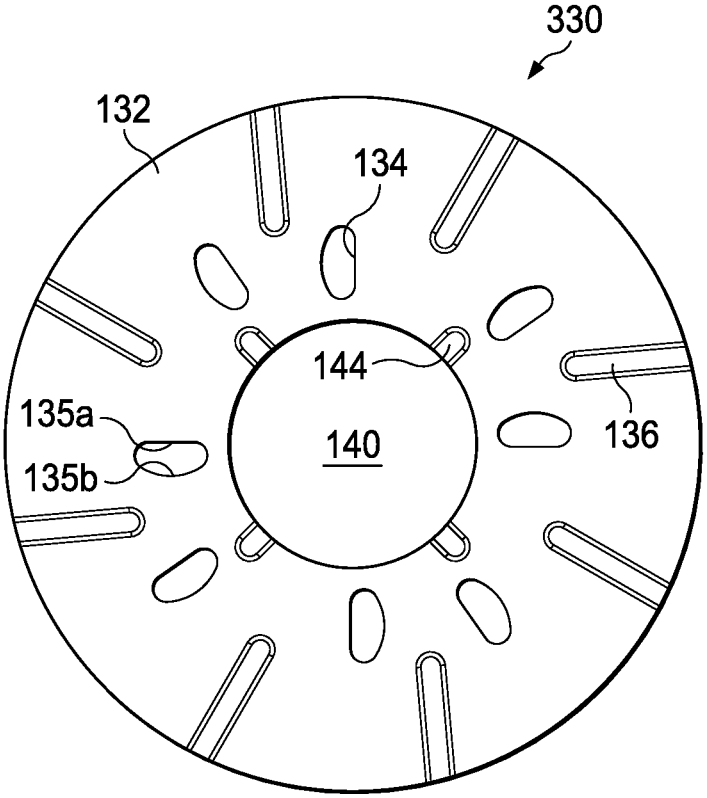
FIG. 17 is a top plan view of a third embodiment of the cutter plate.

FIGS. 16 and 17 are both variations of a cutter plate that could be useful with a cutting body 150 having three arms 154, to demonstrate some flexibility in the design.

The cutter plate 230 depicted in top plan view in FIG. 16 shows the first planar face 132 with through holes 134, each of which has a straight edge 135*a* that is aligned on a radius of the first planar face and a curved face 135*b*. The through holes 134 are arranged so that the straight edge 135*a* will encounter a leading edge 156 of the cutting body rotating in a counterclockwise direction before the corresponding curved edge 135*b* encounters that leading edge. FIG. 16 also has a set of first grooves 136 and a set of second grooves 144. The difference is that cutter plate 230 has sixteen through holes 134, sixteen first grooves 136 and eight second grooves 144, while cutter plate 130 has ten through holes, ten first grooves and five second grooves. If the cross-sectional areas of the individual through holes are approximately the same in the two embodiments 130, 230, the flow through cutter plate 230 would be expected to be higher than through cutter plate 130.

The cutter plate 330 depicted in top plan view in FIG. 17 shows the first planar face 132 with through holes 134, each of which has a straight edge 135*a* that is aligned on a radius of the first planar face and a curved face 135*b*. The through holes 134 are arranged so that the straight edge 135*a* will encounter a leading edge 156 of the cutting body rotating in a counterclockwise direction before the corresponding curved edge 135*b* encounters that leading edge. FIG. 17 also has a set of first grooves 136 and a set of second grooves 144. The difference is that cutter plate 330 has eight through holes 134, eight first grooves 136 and four second grooves 144, while cutter plate 130 has ten through holes, ten first grooves and five second grooves. If the cross-sectional areas of the individual through holes are approximately the same in the two embodiments 130, 330, the flow through cutter plate 330 would be expected to be lower than through cutter plate 130.

A reasonable range for the number of through holes 134 for a cutter plate using the inventive concept would be an even number from about eight to about sixteen, although twelve through holes would not be preferred for use with a cutting body having three arms, as twelve is an integral multiple of three. Likewise, six through holes would also not meet that criterion. However, if five arms are arranged on the cutting body, the cutter plate could have six, eight, twelve, fourteen or sixteen through holes. Of course, the assumption in showing embodiments 130, 230 and 330 is that the diameter of the cutter plate is constant. If the diameter of the cutter plate increases, the number of through holes 134 can be expected to increase if the flow areas of the individual through areas remains constant.

What is claimed is:

1. A grinder accessory configured to couple with a pump, comprising:

a set of co-acting cutter elements, comprising:

a cutter plate having a first planar face and a second planar face, opposite the first planar face, with a plurality of through holes and a central aperture, the cutter plate further comprising a plurality of first grooves on the first planar face, each of the first grooves extending in a non-radial manner from an origin at a circumference of the cutter plate to a termination on the first planar face that is short of an outer diameter of the central aperture; and a cutting body, arranged to extend axially through the central aperture and extend axially outward from each planar face of the cutter plate, a first portion of the cutting body having a plurality of arms that extend radially from a central hub proximate to the first planar face and a second portion of the cutting body that extends axially from the second planar face, the second portion adapted for rotational coupling to a drive shaft of the pump; and a housing, configured to operably mount on or be integral with an inlet of the pump, defining a cutting chamber having an inner diameter effectively equal to a diameter of the cutter plate, which is mounted therein, and an axial height, measured from the first planar face of the cutter plate, that exceeds an axial height of the cutting body as measured from the first planar face.

2. The grinder accessory of claim 1, wherein:

each of the co-acting cutter elements has an axis of rotational symmetry.

3. The grinder accessory of claim 1, wherein:

the number of through holes in the cutter plate exceeds the number of arms of the cutting body.

4. The grinder accessory of claim 3, wherein:

the number of through holes in the cutter plate is an even number and the number of arms of the cutting body is an odd number.

5. The grinder accessory of claim 4, further comprising:

a plurality of second grooves on the first planar face.

6. The grinder accessory of claim 5, wherein:

each of the plurality of second grooves extends in a radial manner from an outer diameter of the central aperture, each of the second grooves having a termination on the first planar face, short of the circumference of the cutter plate.

7. The grinder accessory of claim 3, wherein:

the number of arms in the cutting body is not an integral divisor of the number of through holes in the cutter plate.

8. The grinder accessory of claim 3, wherein:

the number of arms in the cutting body is not an integral divisor of the number of through holes in the cutter plate.

9. The grinder accessory of claim 1, wherein:

each of the plurality of through holes in the cutter plate has a "D"-shape profile, with a straight edge joined to a curved edge.

10. The grinder accessory of claim 9, wherein:

each of the plurality of through holes is located on the cutter plate such that the straight edge is aligned on a radius of the first planar face.

11. The grinder accessory of claim 10, wherein:

each of the plurality of through holes has a counterpart through hole that is diametrically opposed on the first planar face with the respective straight edges aligned on a common diameter.

12. The grinder accessory of claim 1, wherein:

the number of the first grooves is equal to the number of through holes.

13. The grinder accessory of claim 12, wherein:

the termination of each of the plurality of first grooves is located between a pair of adjacent through holes.

14. The grinder accessory of claim 1, further comprising:

an annular rim around, and extending axially from, the second planar face.

15. The grinder accessory of claim 1, wherein:

each arm extends in a radial line from an axis of the central hub to a tip.

16. The grinder accessory of claim 15, wherein:

each arm has a height in the axial direction that decreases from the root to the tip.

17. The grinder accessory of claim 15, wherein:

a maximum height of each arm is along the radial line.

18. The grinder accessory of claim 15, wherein:

each arm has a leading edge that extends in a curved manner from the root to the tip.

19. The grinder accessory of claim 18, wherein:

each arm is hollow behind the leading edge thereof.

20. The grinder accessory of claim 1, wherein:

each of the plurality of through holes in the cutter plate has a "D"-shape profile, with a straight edge joined to a curved edge; and each arm of the cutting body has a leading edge that is curved from a root thereof to a tip thereof;

wherein the through holes and arms are arranged on their respective parts such that when the cutting body rotates relative to the cutter plate, the curved leading edge of the cutting body moves first across the straight edge of the through hole before encountering the curved edge of the through hole.

21. A grinder pump, comprising:

a pump, having a suction inlet; and a grinder accessory according to claim 1, mounted in or integral with the suction inlet.

22. The grinder pump of claim 21, wherein:

the pump further comprises a drive shaft for an impeller thereof, the drive shaft having an end thereof that is aligned with the suction inlet and that is rotationally coupled to the cutting body of the grinder accessory.

* * * * *